United States Patent [19]

Schofield

[11] Patent Number: 4,462,754

[45] Date of Patent: Jul. 31, 1984

[54] TURBINE BLADE FOR GAS TURBINE ENGINE

[75] Inventor: Peter R. Schofield, Bristol, England

[73] Assignee: Rolls Royce Limited, London, England

[21] Appl. No.: 390,959

[22] Filed: Jun. 22, 1982

[30] Foreign Application Priority Data

Jun. 30, 1981 [GB] United Kingdom ..... 8120164

[51] Int. Cl.[3] ..... F01D 5/08

[52] U.S. Cl. ..... 416/97 R; 416/95; 416/96 R; 415/115; 415/116; 415/117

[58] Field of Search ..... 416/95, 96, 97; 415/115, 116, 117

[56] References Cited

U.S. PATENT DOCUMENTS

| | | | |
|---|---|---|---|
| 3,045,965 | 7/1962 | Bowmer | 416/97 |
| 3,807,892 | 4/1974 | Frei et al. | 415/116 |
| 4,136,516 | 1/1979 | Corsmeier | 416/96 R |
| 4,177,010 | 12/1979 | Greaves et al. | 416/97 R |
| 4,302,153 | 11/1981 | Tubbs | 416/96 R |
| 4,326,833 | 4/1982 | Zelahy et al. | 416/96 R |

FOREIGN PATENT DOCUMENTS

| | | | |
|---|---|---|---|
| 48201 | 1/1982 | Japan | 415/115 |
| 742477 | 12/1955 | United Kingdom . | |
| 893706 | 4/1962 | United Kingdom . | |
| 1188383 | 4/1970 | United Kingdom . | |
| 1350424 | 4/1974 | United Kingdom . | |

*Primary Examiner*—Stephen Marcus
*Assistant Examiner*—Kwon John
*Attorney, Agent, or Firm*—Parkhurst & Oliff

[57] ABSTRACT

The blade has an aerofoil portion (16) having a first (23), a second (24), a third (25) and a fourth (26) internal spanwise passage for cooling air arranged in chordwise succession with the first passage being at the leading edge wall (17) of the blade. The first and third passages are connected to respective a cooling air supplies (14A,14B) at the root end (11) of the blade. At the tip (28) of the blade the third passage is connected to the second passage to introduce air, warmed on passing through the third passage, into the second passage and ameliorate undue cooling of the internal walls (19,20) between the first, second and third passages. The third passage is also connected to the fourth passage for supply of cooling air to the trailing region of the blade. The second passage has outlets (24A) to the exterior of the blade whereby the flow through the second passage is controllable independently of the air supply to the fourth passage, i.e. to the trailing region of the blade.

2 Claims, 2 Drawing Figures

TURBINE BLADE FOR GAS TURBINE ENGINE

This invention relates to turbine blades for gas turbine engines.

A known such blade is a hollow structure defining an aerofoil and having external walls connected by internal walls and forming cooling air passages together therewith. The external walls are defined by two side walls and a leading and a trailing edge wall.

In use, such blades are subject to thermal stress because the internal walls tend to remain cooler than the external walls. This condition is particularly pronounced in the leading edge region of relatively thick blades. In that region the temperature of the external walls tends to be high because of the high heat transfer coefficient at the leading edge wall while the temperature of the internal walls tends to be low because, in that region, the internal walls are relatively wide and present a correspondingly large heat transfer area to the cooling air.

It is also known to arrange said passages in chordwise succession and connect them alternately at their opposite spanwise ends so as to provide a serpentine arrangement of passes. This is desirable to establish a relatively high length to flow area ratio but the number of such passes is limited because of pressure losses and the progressive heating of the air. It is, therefore, the practice to provide two cooling systems each having its own supply of fresh cooling air. However, in such cases it can be impossible to avoid a situation of close proximity of the passages receiving the fresh supplies with the result that the internal wall or walls between those passages are overcooled.

According to this invention there is provided an aerofoil turbine blade for gas tubine engines, comprising two opposite side walls, a leading edge wall, a trailing edge wall, and internal walls extending transversely between the side walls; a first spanwise passage defined between the leading edge wall and a first internal wall; a second, a third and a fourth passage defined in succession by said first and by a second, a third and a fourth said internal wall and portions of said side walls; the first and third passages each having an inlet for a cooling air supply at one spanwise end of the blade, the third passage being interconnected with each of the second and fourth passages at the other spanwise end of the blade, and the first, second and fourth passages each having outlets to the exterior of the blade.

In operation, the cooling air flowing through said third passage divides to enter the second and fourth passages after experiencing a temperature rise by convection primarily from its side wall portions. As a result the air in the second passages has an average temperature higher than that in the first and third passages. This means that the first and second walls, though each swept at one side by fresh cooling air, are each swept at their other sides by warmer air and undue cooling of the first and second walls is avoided. Since the first and second walls are relatively close to the leading edge wall where, as mentioned, the heat transfer coefficient is high, the benefit of warming the first and second walls is correspondingly high in terms of low thermal stress.

The temperature of the first and second walls can be determined by the size of the outlet or outlets from the second passage independently of the requirements made on the air in the fourth passage which air is used primarily for cooling the trailing edge region.

An example of a blade according to this invention will now be described with reference to the accompanying drawing wherein.

Figure 1:
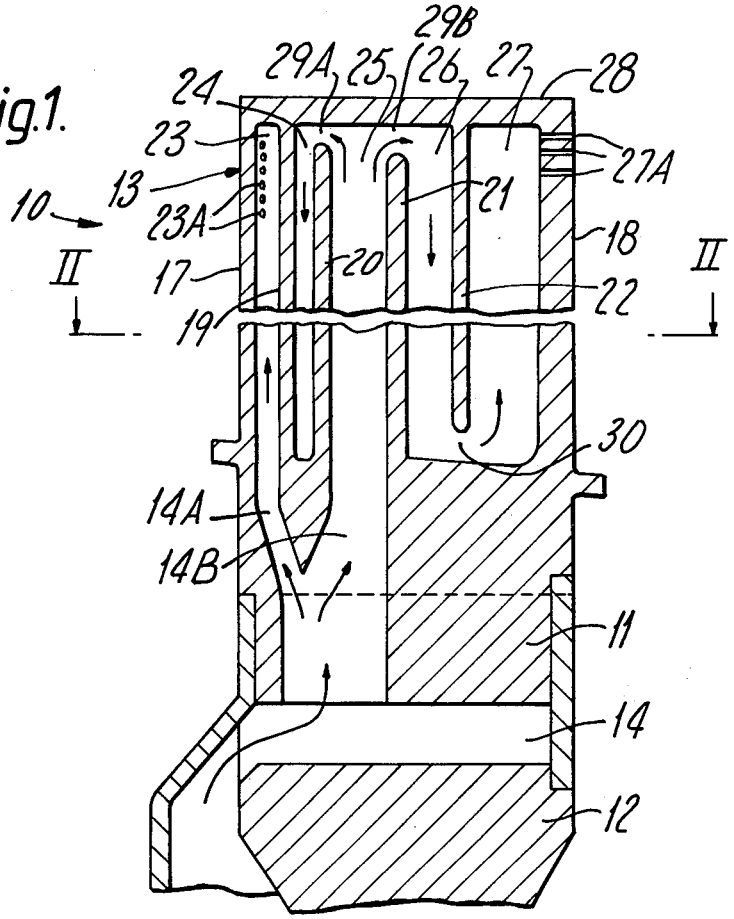
FIG. 1 is a sectional elevation of the blade.
Figure 2:
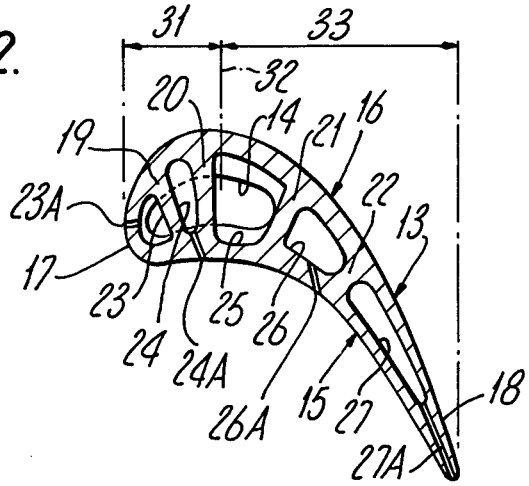
FIG. 2 is a section on the line II in FIG. 1.

The blade, generally denoted 10, is an aerofoil turbine blade for gas turbine engines and has a root portion 11 for attachment to a turbine disc 12. The blade further has an aerofoil portion 13 containing a number of cooling air passages, to be described, connected to a cooling air supply passage 14 provided in the disc.

The aerofoil section 13 comprises two opposite side walls 15,16, a leading edge wall 17 and a trailing edge wall 18. The walls 15 to 18 constitute external walls of the blade. The blade further has internal walls 19,20,21 and 22 which extend transversely between the side walls. The leading edge wall 17 and the internal wall 19 define a first cooling air passage 23 connected at the root end of the blade to the supply passage 14 and having relatively small diameter outlets 23A to the exterior of the wall 23. At the tip end, 28, of the blade, this being the spanwise end remote from the root portion 11, the passage 23 is preferably closed. The internal walls 19,20 and adjacent portions of the walls 15,16 define a second cooling air passage 24. The internal walls 20,21 and adjacent portions of the walls 15,16 define a third cooling air passage 25. The internal walls 21,22 and adjacent portions of the walls 15,16 define a third cooling air passage 26. The internal wall 22, the trailing edge wall 18 and adjacent portions of the walls 15,16 define a fifth cooling air passage 27.

The third passage 25 is connected at the root portion of the blade to the supply passage 14. At the tip end 28 the passage 25 is connected by an interconnecting passage 29A,29B to the passages 24,26. As a result, the air flow which passes through the passage 25 from the root portion 11 divides at the passage 29 to enter the passages 24,26. The passage 24 is closed at the root portion of the blade but has small diameter outlets 24A to the exterior of the wall 15. The passage 26 is connected at the root portion of the blade, by means of an interconnecting passage 30, to the passage 27, and the latter has relatively small diameter outlets 27A through the trailing edge wall 18.

It will be seen that the blade has two cooling systems comprising respectively the passage 23 and the serpentine arrangement of passage 24 to 27, the two systems having individual supplies 14A,14B of fresh cooling air. As will be seen overcooling of the walls 19,20 due to the proximity of the two supplies is avoided or reduced by the supply 14B being led into the third passage 25 and being divided at the passage 29A,29B.

In operation, the external walls 15 to 18 are heated by the combustion products of the engine in respect of which the turbine is installed, the region of highest heat transfer co-efficient being at the leading edge wall 23. As a result, relatively high temperature exists in the leading edge region 31 of a blade, this being the region including the leading edge wall 17 and the adjoining portions of the side walls 15,16 approximately up to a line 32 which defines the maximum thickness of the aerofoil section. If, as in the present case, the blade section is relatively thick, the internal walls 19,20 are relatively wide and present a correspondingly large heat transfer area to the cooling air. In consequence, the wall 19, while being heated by conduction from the walls 15,16, is convection-cooled at a higher rate by the air flowing through the passage 23. But, by virtue of the fact that the supply 14B is led into the passage 25, where the air experiences an initial temperature rise, the air reaching the passage 24 is then relatively warmer and over-cooling of the wall 19 is to that extent reduced. Similarly, the wall 20, though having the relatively cool air of the passage 25 at one side, has the warmer air of the passage 24 at the other side and over-cooling of the wall 20 is also avoided in this way.

The temperature of the air in the passage 24 is controllable by the passages 29A and 24A and is independent of the cooling requirements made on the air entering the passages 26,27 for the purpose of cooling of the trailing edge region, 33, of the blade.

I claim:

1. An aerofoil turbine blade for gas turbine engines, comprising two opposite side walls, a leading edge wall, a trailing edge wall and first, second, third and fourth internal walls extending transversely between the side walls; a first spanwise passage defined between the leading edge wall and a first internal wall; a second, a third and a fourth passage defined in succession by said first internal wall and by said second, said third and said fourth internal walls and portions of said side walls; a first and third passages each having an inlet for a cooling air supply at one spanwise end of the blade, the third passage being interconnected with each of the second and fourth passages at the other spanwise end of the blade, and the first, second and fourth passages each having outlets to the exterior of the blade.

2. A blade according to claim 1, wherein the second passage has an end adjacent said one end of the blade, said end of the second passage is closed and the outlets of the second passage are in the form of openings along the length of the second passage.

* * * * *